US009970328B2

(12) United States Patent
Haerms et al.

(10) Patent No.: US 9,970,328 B2
(45) Date of Patent: May 15, 2018

(54) METHOD FOR BARRING A ROTOR OF A TURBOMACHINE AND BARRING APPARATUS FOR CONDUCTING SUCH METHOD

(71) Applicant: ANSALDO ENERGIA IP UK LIMITED, London (GB)

(72) Inventors: Axel Haerms, Nussbaumen (CH); Felix Staehli, Baden (CH); Marc Rauch, Frenkendorf (CH); Eric Knopf, Würenlingen (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 1029 days.

(21) Appl. No.: 14/156,028

(22) Filed: Jan. 15, 2014

(65) Prior Publication Data

US 2014/0199157 A1 Jul. 17, 2014

(30) Foreign Application Priority Data

Jan. 16, 2013 (EP) ..... 13151429

(51) Int. Cl.
*F01D 21/12* (2006.01)
*F01D 25/34* (2006.01)
(Continued)

(52) U.S. Cl.
CPC ..... *F01D 25/36* (2013.01); *F01D 21/06* (2013.01); *F01D 25/34* (2013.01); *F05D 2260/4031* (2013.01); *F05D 2270/304* (2013.01)

(58) Field of Classification Search
CPC ..... H02P 9/006; F01D 25/36; F01D 25/34; F01D 25/008; F01D 21/12; F01D 21/06; F05D 2270/304; F05D 2260/4031
See application file for complete search history.

(56) References Cited

U.S. PATENT DOCUMENTS 3,141,384 A * 7/1964 Hoffman ..... F01B 9/08 91/178
3,158,067 A * 11/1964 Wagner ..... F01D 25/34 91/37

(Continued)

FOREIGN PATENT DOCUMENTS

CN 200955412 Y 10/2007
CN 202194693 U 4/2012

(Continued)

*Primary Examiner* — Logan Kraft
*Assistant Examiner* — Joshua R Beebe
(74) *Attorney, Agent, or Firm* — Buchanan Ingersoll & Rooney PC

(57) ABSTRACT

A method for barring a rotor of a thermally loaded turbomachine includes stopping normal operation of the turbomachine; providing a barring device for rotating the rotor about a machine axis; coupling the barring device to the rotor; letting the rotor cool down during cool down of the rotor rotating the rotor by means of the barring device. A damage of the machine due to thermally induced buckling during the barring process is avoided by consecutively determining the force or torque applied to the rotor by the barring device for rotating the rotor and/or the circumferential speed of the rotor during barring. The rotation of the rotor is controlled by means of the barring device in dependence of the determined force or torque and/or circumferential speed in order to reduce a bending or imbalance of the rotor, which is due to a nonuniform temperature distribution on the rotor during cool down.

14 Claims, 3 Drawing Sheets

(51) Int. Cl.
*F01D 25/36* (2006.01)
*F01D 21/06* (2006.01)

(56) References Cited

U.S. PATENT DOCUMENTS 3,176,094 A * 3/1965 Ipsen ..... F01D 17/06 200/81 R
3,176,959 A * 4/1965 Ellenberger ..... F01D 17/04 415/19
3,485,041 A * 12/1969 Evans ..... F01D 25/34 192/104 R
3,791,231 A * 2/1974 Geary ..... F01D 25/34 192/104 C
4,018,094 A 4/1977 Schmidt
4,090,409 A 5/1978 Ohleyer
4,151,760 A 5/1979 Bernasconi et al.
4,267,740 A 5/1981 Schwarz
4,687,946 A * 8/1987 Jones ..... F01D 17/20 290/40 R
4,905,810 A 3/1990 Bahrenburg
4,919,039 A * 4/1990 Nutter ..... F15B 15/061 74/578
5,327,718 A * 7/1994 Iwata ..... F02C 7/228 60/39.27
2008/0022687 A1* 1/2008 Althaus ..... F01D 19/02 60/727
2008/0041141 A1* 2/2008 Discenzo ..... G01L 1/241 73/66
2008/0190094 A1* 8/2008 Kauf ..... F01D 25/34 60/39.182
2011/0027061 A1* 2/2011 Noack ..... F01D 21/006 415/1

FOREIGN PATENT DOCUMENTS

DE 44 37 662 4/1996
EP 0 266 581 5/1988
GB 564519 10/1944
SU 151355 A1 12/1962
SU 274124 A1 1/1970
SU 601439 A1 4/1978

* cited by examiner

METHOD FOR BARRING A ROTOR OF A TURBOMACHINE AND BARRING APPARATUS FOR CONDUCTING SUCH METHOD

CROSS-REFERENCE TO RELATED APPLICATIONS

This application claims priority to European application 13151429.1 filed Jan. 16, 2013, the contents of which are hereby incorporated in its entirety.

TECHNICAL FIELD

The present invention relates to the technology of turbomachines. It refers to a method for barring a rotor of a thermally loaded turbomachine according to the preamble of claim 1. It further refers to a barring apparatus for conducting such method.

BACKGROUND

Large turbomachinery rotors have to be rotated during cool down at least at a low speed to assure a uniform cool down (rotor turning/barring operation). The required rotation of the rotor is actuated by special devices (rotor barring or rotor turning devices).

During cool down large temperature deviations are present in the flow channel in circumferential direction by natural convection. If this circumferential temperature deviation is transferred to the rotor, the rotor will bend due to the uneven thermal expansion. Bending of the rotor may lead to contact of the rotor with the stator resulting in a blockage of the rotation. A blocked rotor leads to the unavailability of the turbomachine for operation. Contact between the rotor and stator leads to deterioration of the part condition by rubbing.

Document U.S. Pat. No. 4,905,810 A discloses an apparatus and method for periodic rotation of the rotor assembly of a turbogenerator during the time that it is not rotated in its normal manner for generating power, in which a continuously operating motor is periodically connected through an electrically controllable, torque-speed, clutch mechanism and a gear train to a gear mounted on the rotor shaft so as to rotate the shaft by 180° at a slow speed. The position of the rotor is measured by electrically counting the teeth of the gear on the rotor shaft, and the count of teeth is compared with a preset number in a counter which after the count set in the counter is reached, disconnects the motor from the rotor gear and sets a brake. A settable timer periodically releases the brake and connects the motor to the rotor gear. The apparatus can include a recorder for recording rotation of the shaft and an alarm for indicating failure of rotation of the rotor when the timer provides a start signal.

Document U.S. Pat. No. 4,267,740 A discloses an apparatus for rotating a shaft of a turbine. This apparatus includes a ratchet wheel which is connected to the shaft, and a pawl which engages the teeth of the ratchet wheel. The teeth of the ratchet wheel have bearing surfaces with convex curvatures, while the pawl has a contact surface which also has a convex curvature.

Document EP 0 266 581 A1 discloses an installation for turning the shaft of a turbo set by means of a hydraulic geared motor with interconnection of an overrunning clutch, the shaft being mounted in several hydrodynamic bearings, which preferably also have oil inlets of a shaft-lifting system, characterised in that hydraulic geared motor and overrunning clutch are secured, in alignment with the shaft, to the front wall of the foremost bearing of the shaft, in that, furthermore, the overrunning clutch is mounted by means of rolling bearings and the foremost bearing of the shaft has an additional hydrostatic mounting for the purpose of centering with respect to the overrunning clutch.

Document GB 564,519 A discloses a barring mechanism for the rotors of various kinds of machines and engines, comprising fluid pressure actuated pistons and ratchet gears driven thereby.

However, the existing rotor barring actuators rotate the turbomachine rotor with a constant circumferential speed and can not react to a bending of a rotor which starts to develop.

SUMMARY

It is therefore an object of the present invention to provide a method and apparatus for barring a rotor of a turbomachine during cool down, which reduces or eliminates bending of the rotor due to nonuniform heat distribution during cool down.

This and other objects are obtained by a method according to claim 1 and a barring apparatus according to claim 9.

The inventive method for barring a rotor of a thermally loaded turbomachine comprises the steps of:

- stopping normal operation of said turbomachine;
- providing a barring device for rotating said rotor about a machine axis;
- coupling said barring device to said rotor;
- letting said rotor cool down; and
- during cool down of said rotor rotating said rotor by means of said barring device.

It is characterized in that the force or torque applied to said rotor by said barring device for rotating said rotor and/or the circumferential speed of the rotor during barring are consecutively determined; and

- the rotation of said rotor by means of said barring device is controlled in dependence of said determined force or torque and/or circumferential speed in order to reduce a bending or imbalance of said rotor, which is due to a nonuniform temperature distribution on said rotor during cool down.

According to an embodiment of the method according to the invention the bending or imbalance of said rotor is caused by a nonuniform circumferential temperature profile outside of said rotor, and said rotor is rotated by said barring device such that said nonuniform temperature distribution on said rotor is reduced by said nonuniform circumferential temperature profile outside of said rotor.

Specifically, said rotor is continuously rotated by said barring device, and the circumferential speed is varied in dependence of said determined force or torque and/or circumferential speed.

According to another embodiment of the invention said rotor is rotated by said barring device in an incremental fashion.

Preferably, said rotor is rotated by said barring device using a ratchet and pawl mechanism.

According to just another embodiment of the invention said barring device is driven by an electric motor, and that the current of said motor is measured to determine said force or torque applied to said rotor.

According to a further embodiment of the invention said barring device is driven by a hydraulic pressure, and that said hydraulic pressure is measured to determine said force or torque applied to said rotor.

According to just another embodiment of the invention said turbomachine is a stationary gas turbine.

The inventive barring apparatus for conducting the method according to invention comprises a barring device with a barring drive, which can be coupled to the rotor of said turbomachine. It is characterized in that a control unit is provided for controlling said barring device, and that said control unit receives signals from a speed sensor and/or said barring drive of said barring device.

According to an embodiment of the apparatus according to the invention a speed sensor is provided, and said speed sensor is configured to sense the circumferential speed of said rotor.

According to an embodiment of the apparatus a sensor is provided to measure the force or momentum required for tuning the rotor. In particular the fore or momentum can be determined based on the rotor position (angle).

According to another embodiment of the invention said barring drive comprises an electric motor, and said control unit receives signals, which are related to the electric current flowing through said electric motor. The control unit can be configured to determine the required fore or momentum to turn the rotor based on this signal. In particular the fore or momentum can be determined based on the rotor position (angle).

Specifically, said electric motor is a servo motor.

According to a further embodiment of the invention said barring device comprises a barring mechanism with a pawl, which is designed to interact in a reciprocating manner with a ratchet wheel on said rotor.

BRIEF DESCRIPTION OF THE DRAWINGS

The present invention is now to be explained more closely by means of different embodiments and with reference to the attached drawings.

DETAILED DESCRIPTION

Figure 1:
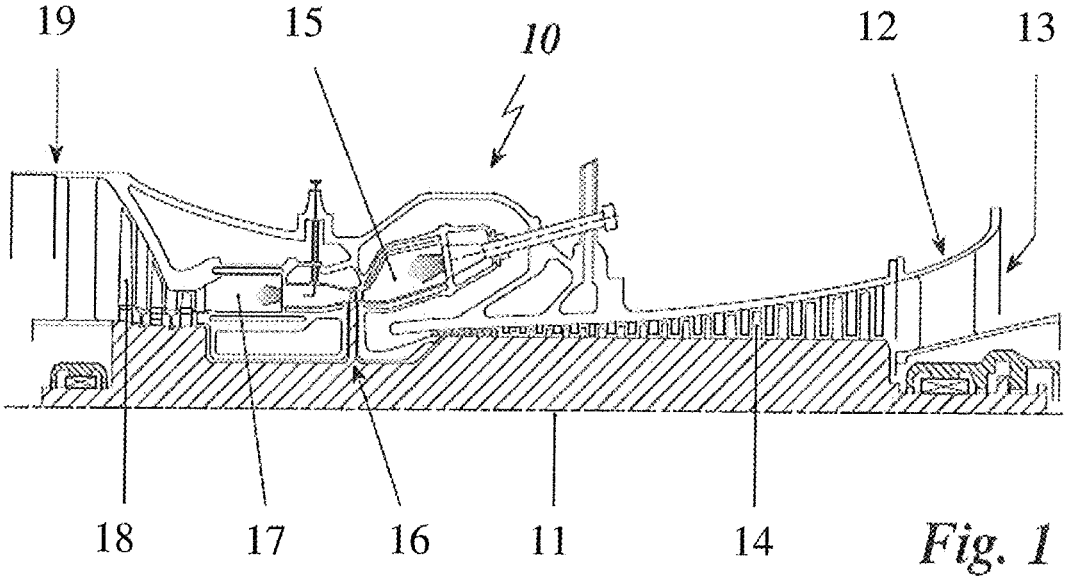
FIG. 1 shows a perspective view of a stationary gas turbine with sequential combustion known in the art.

FIG. 1 shows a perspective view of a stationary gas turbine with sequential combustion known in the art. The gas turbine 10 of FIG. 1, which is of the well-known type GT26, comprises a rotor 11, which rotates about a machine axis (37 in FIG. 5) and is concentrically surrounded by a casing 12. Between the casing 12 and the rotor 11 an annular hot gas channel runs from an air inlet 13 to an exhaust gas outlet 19. A compressor 14 downstream of the air inlet 13 sucks in and compresses air, which is delivered to a first combustor 15, where a first combustion of an injected fuel generates hot gas for a high pressure turbine 16 downstream of said first combustor 15.

After having passed the high pressure turbine 16, the hot gas, which still contains combustion air, is used in a second combustor 17 to burn a second fuel and thereby reheat the hot gas. The hot gas leaving the second combustor 17 drives a low pressure turbine 18 and flows to the exhaust gas outlet 19 to be released either to a stack or a heat recovery steam generator in case of a combined cycle power plant CCPP.

When such a gas turbine 10 is switched off after normal operation, a nonuniform circumferential temperature distribution in the hot gas channel leads to a nonuniform circumferential temperature distribution in the rotor, which tends to bend the rotor with respect to its axis due to the different thermal expansion at the different temperatures, even when the rotor is barred with a constant rotation speed during cool down.

According to the idea of the present invention, rotor barring operation varies the actuator speed around the circumference to keep or to bring back the rotor of large turbomachines in straight and coaxial condition.

A bending of the rotor during cool down will lead to a "buckle" of the rotor, to which the gravity force is acting. The gravity force on the buckle will lead to uneven rotor barring/turning actuators force around the circumferential direction. In addition, the rotation speed around the circumference of the rotor will vary.

Consequently, a continuous monitoring and evaluation of the actuator force and/or the turbomachine rotor speed around the circumference shall be introduced. By this evaluation the location of the rotor buckle or the circumferential disturbance is determined. The circumferential speed will be varied. By the variation of rotational speed the available (nonuniform) surrounding circumferential temperature profile will be used to straighten the rotor back to the coaxial condition.

Figure 2:
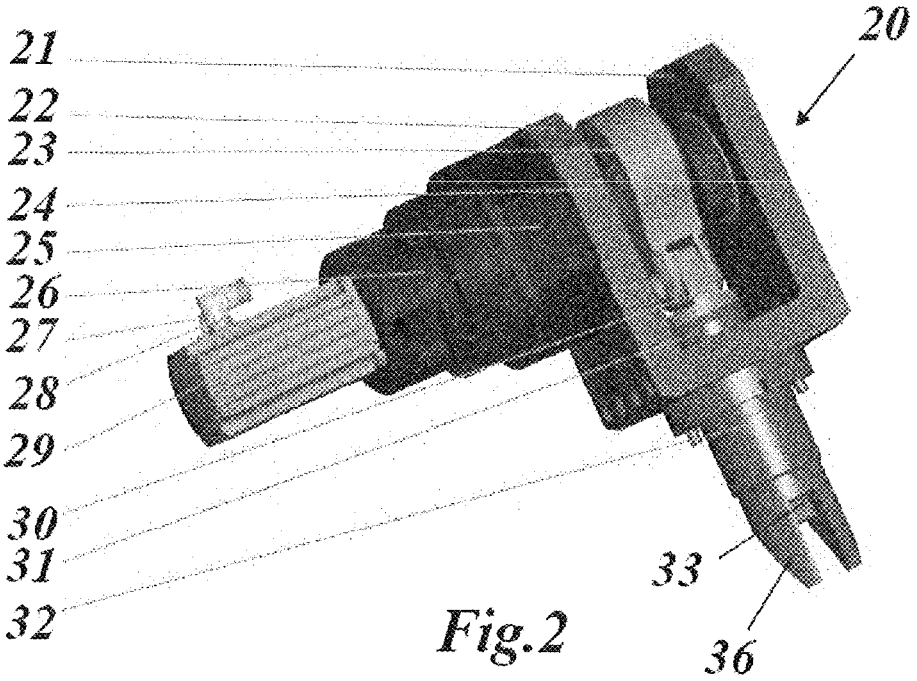
FIG. 2 shows in a perspective view a barring device as part of a ratchet and pawl mechanism.

FIG. 2 shows in a perspective view a barring device, which may be used as part of a ratchet and pawl mechanism similar to the one of document U.S. Pat. No. 4,267,740 A cited before. The barring device 20 of FIG. 2 comprises an eccentric shaft 2A, which is rotatable supported by a U-bracket angle 21 and U-bracket plate 22 of a U-bracket. The eccentric shaft is driven by a servo motor 29, which is connected to the shaft via a gear box 26 and coupling case 25. On the eccentric shaft 24 a rod 23 is arranged, which converts the rotation of the shaft 24 into a reciprocating movement driving a barring piston 31 via a rod end bearing 30. The reciprocating movement of the barring piston 31 in the barring case 32 leads to a respective movement of a pawl 33 arranged at the free end of the piston in the interior of bracket 36. As shown in detail in FIG. 4, the pawl 33, which is loaded by a spring 35, engages the teeth of a ratchet wheel 34 on the rotor during the barring action. A barring device 20 according to FIG. 2 can be integrated into the gas turbine as for example shown in FIG. 3.

Figure 5:
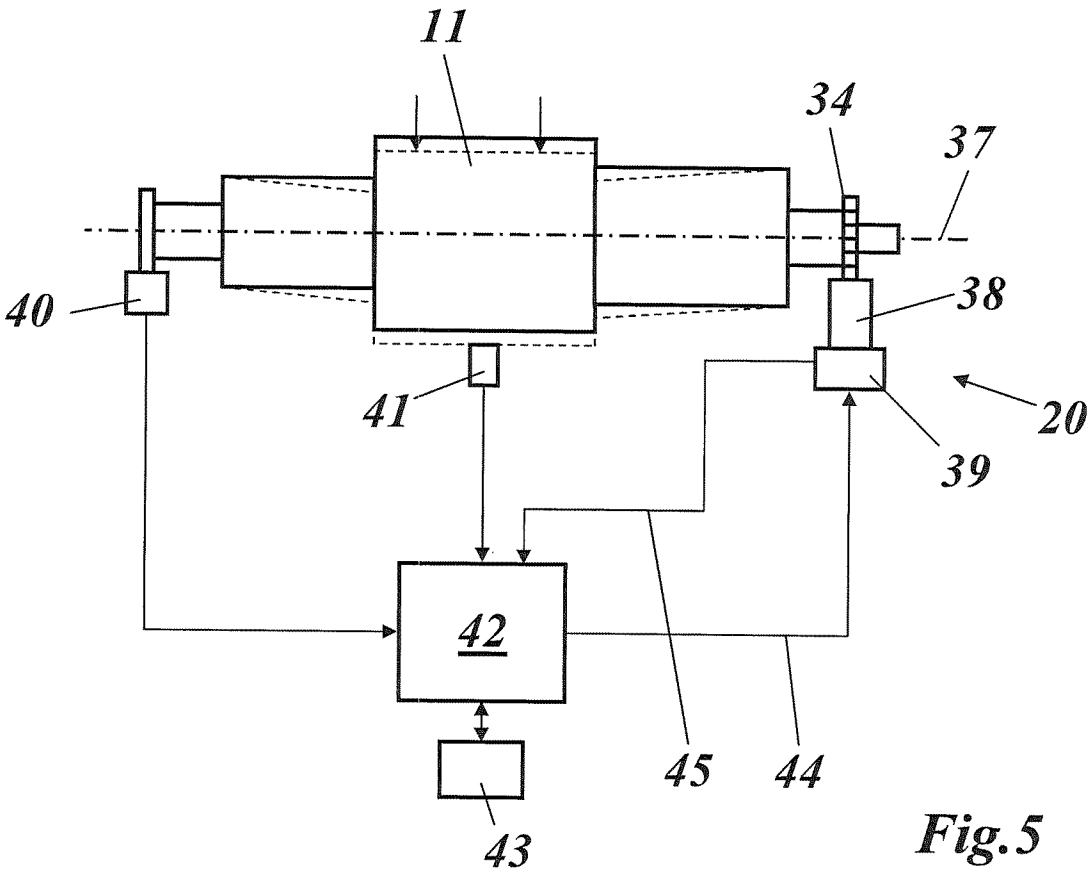
FIG. 5 shows e control scheme of a barring apparatus according to an embodiment of the invention.

The servo motor 29 is equipped with a power connector 28 for being supplied with electric power, and with a signal connector 27 for receiving control signals and sending signals with regard to the actual power or current used during the barring process (see FIG. 5).

Figure 3:
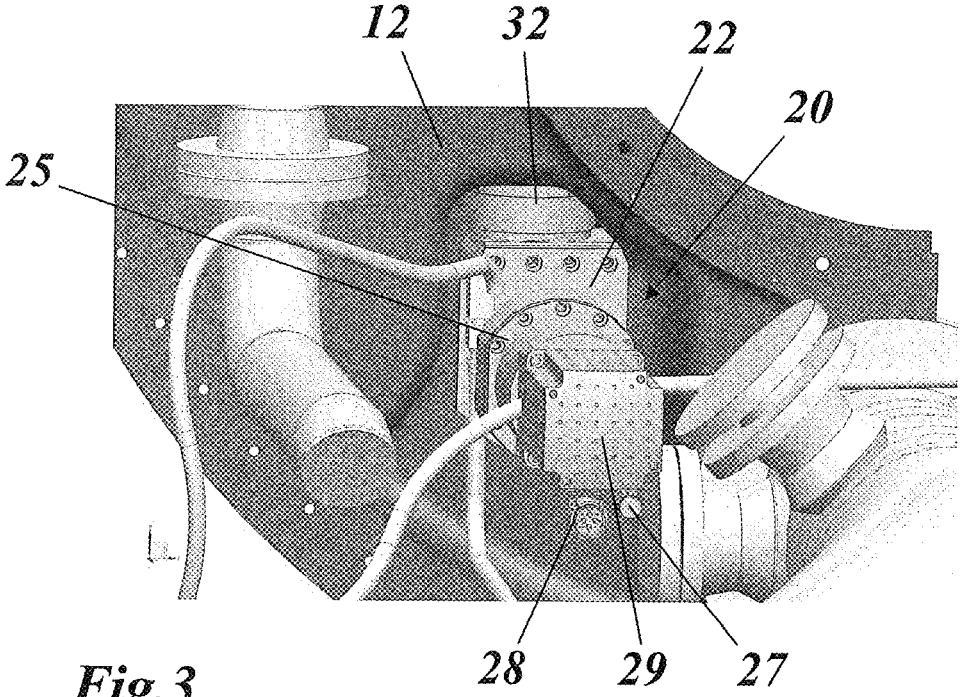
FIG. 3 shows the integration of a barring device according to FIG. 2 into a gas turbine.
Figure 4:
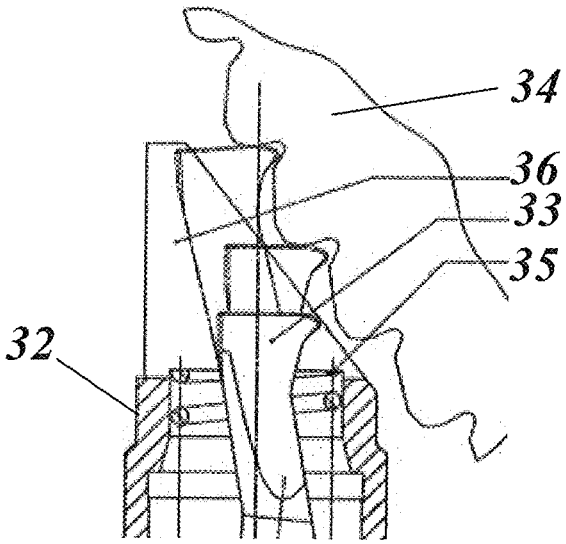
FIG. 4 shows the ratchet and pawl mechanism involving a barring device according to FIG. 2.

Other kinds of barring devices may be used instead of the ratchet and pawl mechanism shown in FIGS. 2 to 4.

To get information about the unbalance or bending of the rotor caused by the nonuniform temperature distribution the force, which is necessary for the barring process, can be measured. This actuator force or torque can be either directly measured by e.g. a force sensor arranged at the pawl, or the like, or indirectly evaluated. Indirect evaluation methods comprise measuring the current of the electrical actuator motor or the actuation medium pressure of a pneumatic or hydraulic actuator.

In addition or alternatively, the circumferential speed of the rotor may be measured or determined.

As said before, a continuous monitoring and evaluation of the actuator force and/or the turbomachine rotor speed around the circumference gives the necessary information of the location of a rotor buckle or a circumferential disturbance.

During the cool down process the circumferential speed will be varied. By the variation of the rotational speed the available (nonuniform) surrounding circumferential temperature profile will be used to straighten the rotor back to the coaxial condition.

FIG. 5 shows a simplified scheme of a respective barring arrangement. The rotor 11, the bending of which is represented by the slashed lines, rotates about the machine axis 37. The circumferential speed may be measured by speed sensors 40 and/or 41, which are positioned at parts of the rotor with different radius, thereby providing a different sensitivity due to the different circumferential speed. The signals from the speed sensors 40, 41 are fed to a control unit 42, which controls the action of the barring device 20. In this example, the barring device is of the ratchet and pawl type and has a barring mechanism 38 co-operating with ratchet wheel 34 in a manner explained before.

The barring drive 39 receives control signals from the control unit 42 over a control line 44 and sends information about the electric power used over a signal line 45 back to the control unit 42. The control unit 42 may be connected to a display/control console 43 for displaying various parameters during the barring process and getting input commands at the various stages of the process.

During cool down of a gas turbine as shown in FIG. 1, a temperature difference of about 80° C. may exist between upper and lower side of the turbine casing. If the rotor stood still, its upper side would be warmer resulting in buckling at the upper side.

In case of such a buckling the respective side should be kept in the lower and cooler region of the gas turbine for a longer time.

When the barring torque is measured or determined, this can be done by:

- determining the torque of an electric drive, for example via a measurement of the drive current or voltage;
- measuring directly the applied force, e.g. by means of a strain gauge, or the like;
- measuring the hydraulic pressure in a hydraulic barring drive.

If the barring torque to be supplied is high, the position of the rotor buckle is on the side, where the barring torque is applied. Accordingly, this side is rotated with elevated speed through the (hotter) upper part of the casing (after a rotation of about 90°), and is rotated with reduced speed through the (cooler) lower part of the casing (after a rotation of about 270°).

Rotation can be a continuous turning. However, the rotor turning can be accomplished by said barring device in an incremental fashion. An incremental turning is for example accomplished if said rotor is rotated by said barring device using a ratchet and pawl mechanism. For such a system the turning speed is determined by the time interval between engaging and/or pushing cycles of the ratchet and pawl mechanism, i.e. the time interval is reduced between two pushing or bearing actions is reduced to increase the turning speed. Continuous supervision or measurement for such a bearing device can mean that the force, respectively momentum is determined during the times of interaction of the ratchet and pawl mechanism.

In special cases the rotor can be stopped with the buckle positioned at the lower part of the casing. The actual rotation speed during barring and a possible resting time at a certain position depend on the determined magnitude of the buckling effect, and are approximately proportional to the variation of the torque.

The barring mechanism can engage the rotor shaft at any place. However, it is advantageous to place the mechanism at the cool end of the gas turbine, i.e. at the compressor side.

By practicing the invention the availability of the turbomachine is increased, since rotor blockages are avoided.

The invention claimed is:

1. A method for barring a rotor of a thermally loaded turbomachine, comprising:

stopping normal operation of said turbomachine;

providing a barring device for rotating said rotor about a machine axis;

coupling said barring device to said rotor; and providing cool down of said rotor;

wherein during cool down of said rotor:

rotating said rotor by means of said barring device;

determining consecutively by measurement, a force or torque applied to said rotor by said barring device for rotating said rotor and/or the circumferential speed of the rotor during barring;

identifying a position of a bending or imbalance of said rotor based on the force or torque applied to said rotor and/or the circumferential speed of the rotor; and controlling the rotation of said rotor by means of said barring device in dependence of said determined force or torque and/or circumferential speed in order to reduce a bending or imbalance of said rotor, which is due to a nonuniform temperature distribution on said rotor during cool down, wherein said barring device includes a shaft, a pin, and a piston, the barring device initiating a barring action on the rotor by generating, via the pin, a reciprocating movement of rotation of the shaft to drive the piston for engagement of the rotor.

2. The method according to claim 1, wherein the bending or imbalance of said rotor is caused by a nonuniform circumferential temperature profile outside of said rotor, and that said rotor is rotated by said barring device such that said nonuniform temperature distribution on said rotor is reduced by said nonuniform circumferential temperature profile outside of said rotor.

3. The method according to claim 2, wherein said rotor is continuously rotated by said barring device, and that the circumferential speed is varied in dependence of said determined force or torque and/or circumferential speed.

4. The method according to claim 1, wherein said rotor is rotated by said barring device in an incremental fashion.

5. The method according to claim 4, wherein said rotor is rotated by said barring device using a ratchet and pawl mechanism, wherein said pawl mechanism is engaged by said piston.

6. The method according to claim 1, wherein said barring device is driven by an electric motor, and that the current of said motor is measured to determine said force or torque applied to said rotor.

7. The method according to claim 1, wherein said barring device is driven by a hydraulic pressure, and that said hydraulic pressure is measured to determine said force or torque applied to said rotor.

8. The method according to claim 1, wherein said turbomachine is a stationary gas turbine.

9. A barring apparatus for conducting the method according to claim 1, said barring apparatus comprising a barring device with a barring drive coupled to the rotor of said turbomachine, and a control unit provided for controlling said barring device, wherein said control unit receives signals from a speed sensor and/or said barring drive of said barring device.

10. The barring apparatus according to claim 9, wherein the speed sensor provided is configured to sense the circumferential speed of said rotor.

11. The barring apparatus according to claim 9, wherein said barring drive comprises an electric motor, and that said control unit receives signals, which are related to the electric current flowing through said electric motor.

12. The barring apparatus according to claim 11, wherein said electric motor is a servo motor.

13. The barring apparatus according to claim 9, wherein said barring device comprises a barring mechanism with a pawl, which is designed to interact in a reciprocating manner with a ratchet wheel on said rotor.

14. A gas turbine comprising a barring apparatus according to claim 9.

* * * * *